US006471475B1

(12) United States Patent
Sasu et al.

(10) Patent No.: US 6,471,475 B1
(45) Date of Patent: Oct. 29, 2002

(54) INTEGRATED DUCT DIFFUSER

(75) Inventors: Ioan Sasu, Brossard; Andre LeBlanc, St. Bruno; Michel Bellerose, Boucherville, all of (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 09/616,998

(22) Filed: Jul. 14, 2000

(51) Int. Cl.[7] ..... F01D 1/02; F03B 1/00; F04D 29/44

(52) U.S. Cl. ..... 415/211.2

(58) Field of Search ..... 415/208.1, 208.2, 415/208.3, 211.2, 226

(56) References Cited

U.S. PATENT DOCUMENTS

| | | | | | |
|---|---|---|---|---|---|
| 1,042,506 | A | * | 10/1912 | Vallat | 415/208.2 |
| 2,609,141 | A | * | 9/1952 | Aue | 415/210.1 |
| 2,634,685 | A | | 4/1953 | Buchi | |
| 3,333,762 | A | | 8/1967 | Vrana | |
| 3,832,089 | A | | 8/1974 | Moellmann | |
| 4,012,166 | A | | 3/1977 | Kaesser et al. | |
| 4,854,126 | A | | 8/1989 | Chevis et al. | |
| 5,077,967 | A | * | 1/1992 | Widener et al. | 415/211.2 X |
| 5,297,930 | A | * | 3/1994 | Moore | 415/208.1 X |
| 5,564,898 | A | * | 10/1996 | Richards et al. | 415/211.2 |
| 5,592,820 | A | * | 1/1997 | Alary et al. | 60/751 |
| 5,626,018 | A | * | 5/1997 | Hatfield | 60/726 |
| 6,123,506 | A | | 9/2000 | Brand et al. | |

FOREIGN PATENT DOCUMENTS

| | | | | |
|---|---|---|---|---|
| DE | 713617 | * | 11/1941 | 415/211.2 |
| DE | 937969 | * | 1/1956 | 415/211.2 |

* cited by examiner

*Primary Examiner*—John E. Ryznic
(74) *Attorney, Agent, or Firm*—Todd D. Bailey

(57) ABSTRACT

The invention provides a diffuser assembly constructed of internal and external concentrically nested bowl-shaped shells for directing an outward flow of compressed air from a centrifugal compressor impeller to an axially rearward diffused annular flow. One of the shells is formed with grooves separated by seam edges and the other shell includes a smooth surface of revolution. The grooves on the one shell are closed by the other shell when the two shells are nested together and the seam edges are secured to the smooth surface by fastening means thus defining individual diffuser ducts extending from the compressor impeller to the outer shell edges. The shells can be easily manufactured from metal castings and sheet metal respectively, thereby eliminating much of the cost and the time involved in fabricating prior art diffusers of multiple formed pipes brazed to a separately machined hub. This construction can be easily reinforced for vibration control and the thickness of diffuser duct walls can be optimized for improved performance and minimum weight. The designers are freed from many of the constraints imposed by conventional diffuser design. The shape and cross-section of the diffuser ducts become completely independent of the manufacturing method, permitting the diffuser duct shape to be optimized for aerodynamic efficiency. The costs of production are reduced since tooling costs and manufacturing complexity are dramatically reduced when only two shell parts are required.

17 Claims, 2 Drawing Sheets

INTEGRATED DUCT DIFFUSER

FIELD OF THE INVENTION

The invention relates to a gas turbine engine, particularly to an integrated duct diffuser assembly for directing outward flow of compressed air from a centrifugal compressor impeller to an axial rearward diffused annular flow.

BACKGROUND OF THE INVENTION

The compressor section of a gas turbine engine includes a diffuser downstream of the compressor turbine and a centrifugal impeller upstream of the combustor. The function of a diffuser is to reduce the velocity of the compressed air and simultaneously increase the static pressure thereby preparing the air for entry into the combustor at a low velocity. High pressure low velocity air presented to the combustor section is essential for proper fuel mixing and efficient combustion.

The present invention is particularly applicable to gas turbine engines which include a centrifugal impeller at the high pressure stage of the compressor. Impellers are used generally in smaller gas turbine engines. A compressor section may include axial or mixed flow compressor stages with the centrifugal impeller as the high pressure section, or alternatively a low pressure impeller and the high pressure impeller may be joined in series.

A centrifugal compressor impeller draws air axially from a small diameter. Rotation of the impeller increases the velocity of the air flow as the input air is directed over impeller vents to flow in a radially outward direction under centrifugal force. In order to redirect the radial flow of air exiting the impeller to an annular axial flow for presentation to the combustor, the diffuser assembly is also provided to redirect the air from radial to axial flow and to reduce the velocity and increase static pressure.

A conventional diffuser assembly generally comprises a machined ring which surrounds the periphery of the impeller for capturing the radial flow of air and redirecting it through generally tangential orifices into an array of diffuser pipes. The diffuser pipes are generally brazed or mechanically connected to the ring and have an increasing cross-section rearwardly.

Fabrication of the diffuser pipes is extremely complex since they have a flared internal pathway that curves from a generally radial tangential direction to an axial rearward direction. Each pipe must be manufactured to close tolerances individually and then assembled to the machined diffuser ring. Complex tooling and labour intensive manufacturing procedures result in a relatively high cost for preparation of the diffusers.

In operation as well, diffusers often cause problems resulting from the vibration of the individual diffuser tubes. To remedy vibration difficulties, the diffuser pipes may be joined together or may be balanced during maintenance procedures.

From an aerodynamic standpoint the joining of individual diffuser pipes to the machined ring results in surface transitions which detrimentally affects the efficiency of the engine. On the interior of the pipe as it joins the orifice in the ring, there is often a step or transition caused by manufacturing tolerances in the assembly and brazing procedures. Since the air in this section flows at extremely high velocity, the disturbance in air flow and increase in drag as the air flows over inaccurately fit transitions can result in very high losses in efficiency.

In general, the conventional design of diffusers is not optimal since their complex structure requires a compromise between the desired aerodynamic properties and the practical limits of manufacturing procedures. For example, the orifices in the diffuser ring are limited in shape to cylindrical bores or conical bores due to the limits of economical drilling procedures. The shape of the diffuser pipes themselves is also limited by the practical considerations of forming their complex geometry. In general, the diffuser pipes are made in a conical shape and bent to their helical final shape prior to brazing. Whether or not this conical configuration is optimal for aerodynamic efficiency becomes secondary to the considerations of economical manufacturing.

In order to reduce the tooling and manufacturing costs associated with prior art diffuser assemblies and optimize the diffuser structure for improved aerodynamic efficiency and vibration behavior without concern for the manner in which the diffuser will be actually manufactured, an improved diffuser design is described by Brand et al, in their U.S. patent application Ser. No. 09/233,023, filed on Jan. 20, 1999 commonly owned, which is herein incorporated by reference. The improved diffuser design of Bland et al is simply constructed of two concentric nested shells, secured together by brazing, each shell having opposing mating grooves which when the shells are nested together, define an array of diffuser ducts extending from an inner peripheral compressor impeller casing to an annular axially directed outer edge.

The diffuser design described by Brand et al significantly reduces the tooling and manufacturing costs associated with prior art diffuser assemblies because the individual pipes are replaced by the array of diffuser ducts defined between two concentric nested shells. Nevertheless, the mating of the opposing grooves on the respective nested shells still requires relatively accurate tooling and manufacturing, and therefore it is desirable to further improve the design of the diffuser assembly to better achieve the aims for which the diffuser assembly described by Brand et al is intended.

SUMMARY OF THE INVENTION

It is an object of the invention to provide a diffuser assembly which significantly reduces the tooling and manufacturing costs associated with prior art diffuser assemblies.

It is another object of the invention to provide a diffuser assembly which provides greater flexibility to the designers of gas turbine engines enabling them to optimize the diffuser structure for improved aerodynamic efficiency and vibration behavior without concern for the manner in which the diffuser will be actually manufactured.

It is a further object of the invention to provide a diffuser assembly which has shorter development time for new engines and considerably shorter lead time in normal production by minimizing the operations required for production.

It is a further object of the invention to eliminate the internal transversal steps between the diffuser pipes and a separate internal machined ring of the prior art.

It is a further object of the invention to lower the weight of engines by reducing the number of parts in a diffuser assembly, and using curved or variable diffuser ducts to reduce the gas generator case diameter.

The invention provides a diffuser assembly for directing a flow of compressed air with a radial component from a centrifugal compressor impeller to a diffused annular flow having an axial component. The diffuser assembly comprises a first bowl-shaped casing shell having a first annular diffuser portion, a first downstream annular edge co-axial with the first annular diffuser portion, and a surface having a plurality of grooves extending therebetween and separated by seam edges; and a second bowl-shaped casing shell having a second annular diffuser portion concentric with the first annular diffuser portion, a second annular downstream edge co-axial with the second diffuser portions and a smooth surface of revolution extending therebetween. The first and second bowl-shaped casing shells are concentrically nested. The second shell closes the grooves at the surface of revolution thus defining a diffuser at the first and second diffuser portions and a plurality of individual diffuser pipes extending from the diffuser to the first and second downstream edges when the seam edges of the first shell are secured to the surface of revolution of the second shell.

The first shell could be an inner shell, the surface having the grooves being an external surface thereof, and the second shell is correspondingly an outer shell the surface of revolution being an internal surface thereof; or vice versa.

Preferably the seam edges are located on lands extending laterally between adjacent grooves and the lands extending continuously the length of the grooves. This construction reinforces the structure to resist vibration through the diaphragm action of the lands which are preferably brazed to the surface of revolution of the second shell. The shells can be easily manufactured from metal, the first shell, for example, from castings and the second shell from sheet metal preferably in a pressing process, thereby eliminating much of the cost and time involved in fabricating prior art diffusers constructed of multiple bent pipes brazed to a separately machined hub.

Several significant advantages result from this novel diffuser design. The costs of production are reduced since tooling costs and manufacturing complexity are dramatically reduced when only two shell parts are required. Conventional diffuser assemblies in contrast, require the separate manufacture of several individual diffuser pipes, the machining of a diffuser hub and precise fitting and brazing of the pipes to the hub. Better performance results from elimination of the internal transversal steps which are present in prior art diffusers at the joint between the hub and each of the pipes. It is noted that the costs of production are further reduced in contrast to the diffuser assembly formed by the nested shells, each having opposing mating grooves, as described in Brand's diffuser assembly. One of the grooved shells is replaced by a cover shell having a smooth surface of revolution which is easier and less expensive to manufacture, for example, using a sheet metal pressing process. Furthermore, the mating of the opposing grooves on each shell is replaced by securing the seam edges between the grooves on the casing shell to the surface of revolution of the cover shell so that the manufacturing complexity is further reduced.

The designer is freed from many of the constraints imposed by conventional diffuser manufacturing techniques. To a large extent, conventional diffuser configurations are dictated by the limitations of fabrication. Many trade-offs between diffuser performance and manufacturing costs compromise the efficiency of prior art diffusers.

The invention however, releases the designer from many of the considerations dictated by prior art manufacturing methods. Using the nested shells of the invention, the shape and cross-section of diffuser ducts become completely independent of the manufacturing method used, permitting the diffuser duct shape to be optimized for aerodynamic and structural efficiency.

By adoption of curved or variable diffusion diffuser ducts, the invention can result in lower overall engine weight by reducing the gas generator case diameter. In conventional engines, the diameter of the compressor impeller combined with the outwardly disposed diffuser assembly largely determines the gas generator case diameter. Any reduction in the outward diameter of the diffuser assembly will reduce the gas generator case diameter and lead to a smaller engine of lesser weight and reduced external drag. The invention provides the designer with the freedom to reduce the external diffuser diameter by curving the diffuser ducts inwardly or by using variable cross-sectional profiles for the diffuser ducts. It is also possible to integrate either the casing shell or cover shell, whichever is an outer shell into the casing wall of the gas generator to further reduce the overall engine weight.

The thickness of diffuser duct walls can be optimized for improved performance and minimum weight. If needed, reinforcement can be positioned in selected zones of increased thickness or may include external reinforcing ribs to control vibration, accommodate localized stresses or resist wear.

Design changes can be incorporated with considerably shorter lead time and development of new engines can proceed more rapidly. No tooling is needed to produce prototype testings. Solid model data can be used with laser photolithographic metal powder casting techniques to rapidly produce metal prototypes for example.

Further details of the invention and its advantages will be apparent from the detailed description and the drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF THE PREFERRED EMBODIMENT

Figure 1:
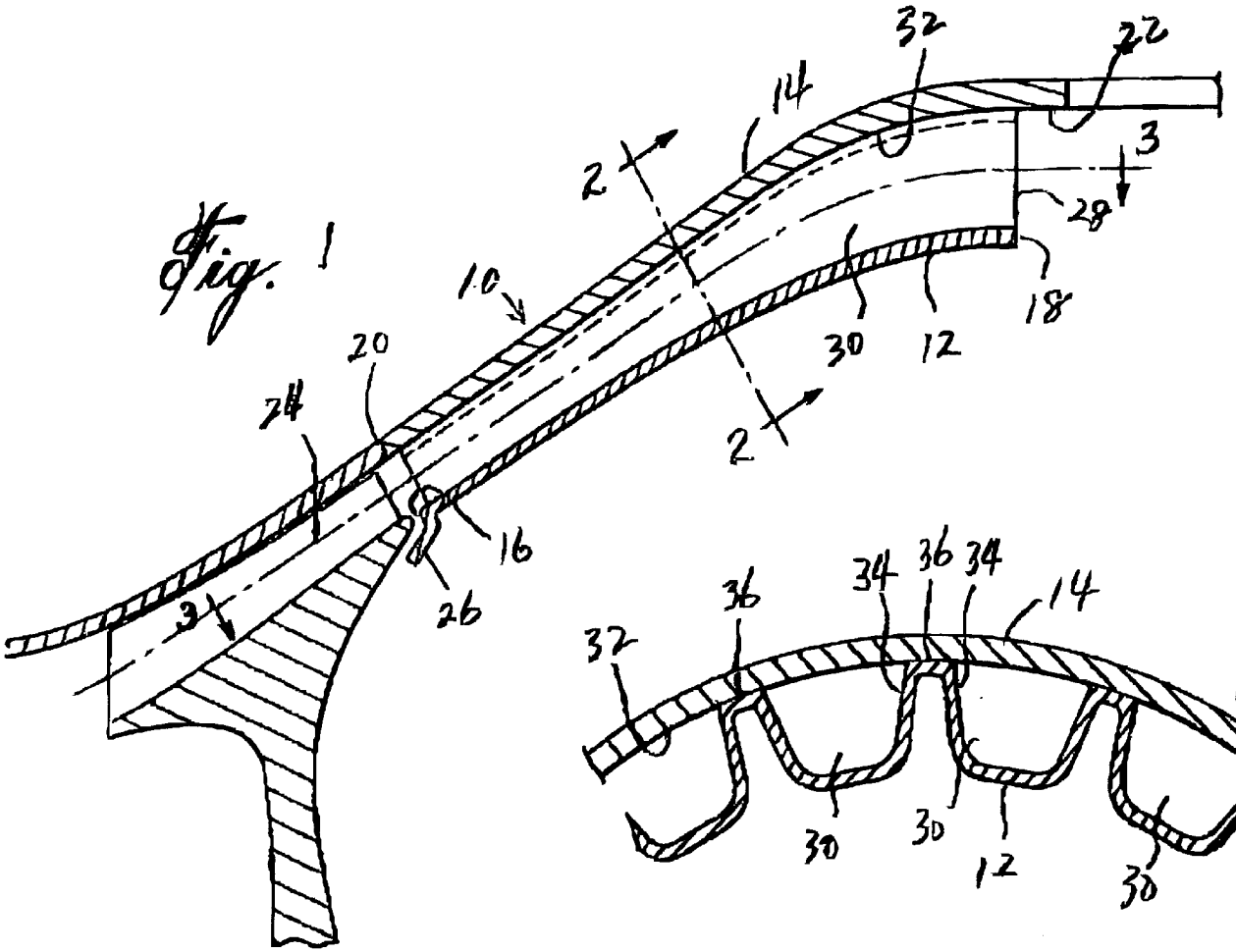
FIG. 1 is a partial radial cross-sectional view of a diffuser assembly according a preferred embodiment of the invention showing the diffuser duct for directing an outward flow of compressed air from a centrifugal compressor impeller to an axial rearward diffused annular flow.
Figure 2:
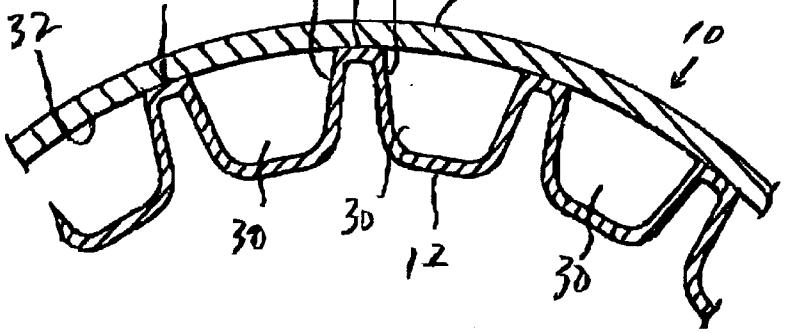
FIG. 2 is a partial cross-sectional view taken along line 2—2 in FIG. 1, showing the bowl-shaped cover and casing shells nested together to form an array of diffuser ducts.
Figure 3:
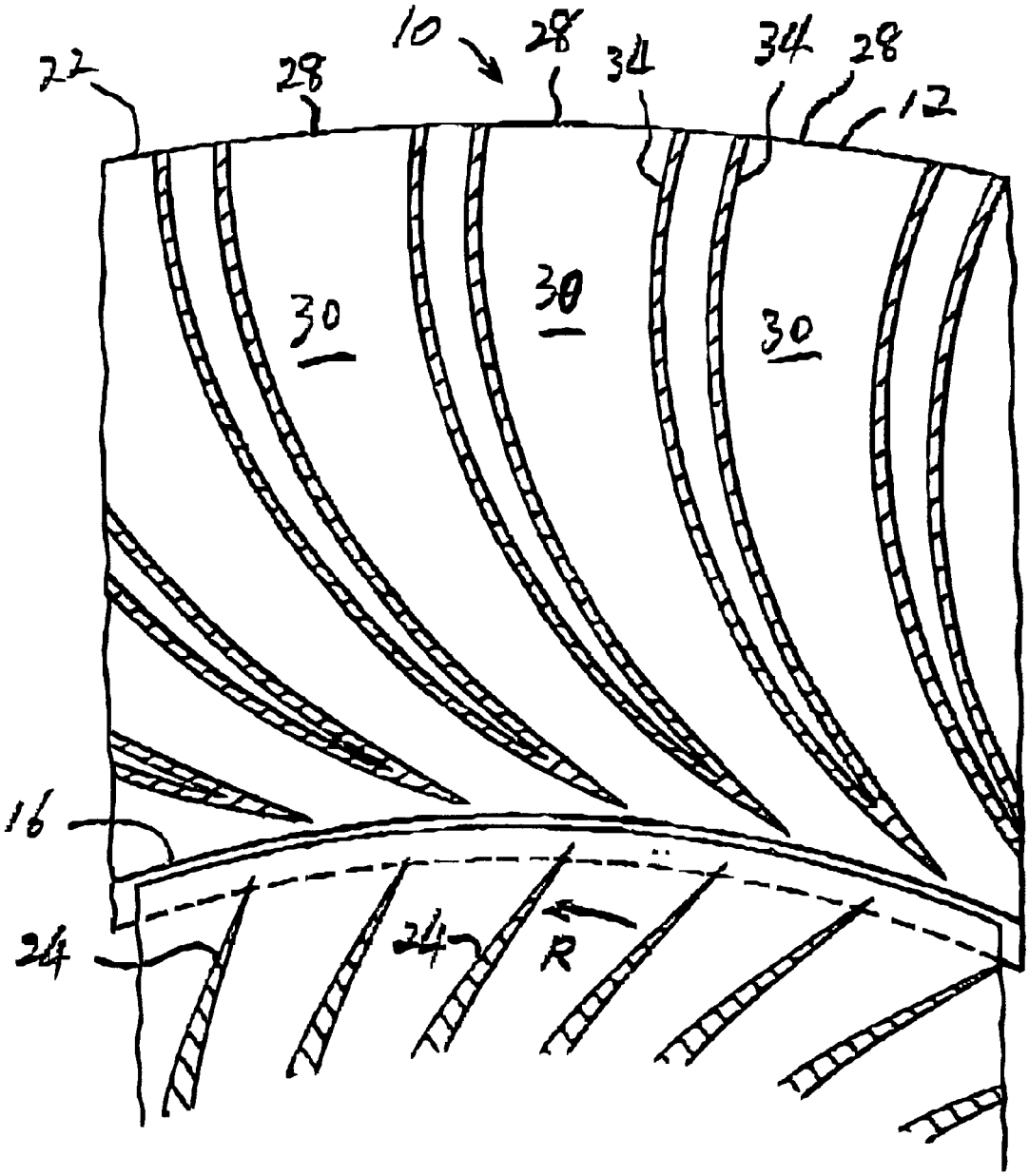
FIG. 3 is a partial cross-sectional view taken along line 3—3 in FIG. 1, showing the spiral directions of the curved diffuser ducts extending from the central compressor impeller to axially directed exit nozzles at the outer edge of the diffuser assembly.

Referring to the drawings from FIG. 1 through FIG. 3, a diffuser assembly according to a preferred embodiment of the invention, generally indicated at numeral 10, includes an internal and external concentrically nested bowl-shaped shells identified respectively with reference to numerals 12 and 14. The internal shell 12 is a casing shell having an annular inner diffuser portion 16, and an outer peripheral edge 18 co-axial with the inner peripheral compressor impeller casing 16. The external shell 14 is a cover shell having a annular inner diffuser portion 20, and an outer peripheral edge 22 co-axial with the inner peripheral compressor impeller casing 20. When the shells 12 and 14 are nested together as shown in FIG. 1, the casings 16 and 20 contain the outward flow of air exiting from the periphery of the impeller 24, as it rotates at a high speed in a direction indicated by arrow R shown in FIG. 3.

The impeller casing 16 of the casing shell 12 preferably includes a skirt portion 26 extending under the blades of the impeller 24 for better receiving the outward air flow. The outward air flow contained within the diffuser portions 16 and 20 is redirected between the casing shell 20 and the cover shell 14, exiting through nozzles 28 formed along the outer edges 18 and 22 of the respective casing shell 12 and the cover shell 14.

To redirect and diffuse the air flow from a high pressure outwardly directed flow from the impeller casing 16 and 20 to an axially rearwardly directed flow past the outer edges 18 and 22, an array of grooves formed in the outer surface of the casing shell 12 are closed by a smooth surface of revolution that is an annularly continuous inner surface 32 of the cover shell 14, which define individual diffuser ducts when the casing shell 12 and the cover shell 14 are secured together with fastening means (not visible).

In the embodiment shown, the grooves 30 are separated by abutting seam edges 34 which are disposed on lands 36 extending laterally between adjacent grooves 30. The lands 36 extend in the embodiment illustrated continuously the length of the grooves 30. The continuous lands 36 join adjacent diffuser ducts together with a continuous diaphragm which can be secured to the surface 32 of the cover casing 14 with fastening means such as brazing, riveting, bolting, spot welding, diffusion welding or fusion welding for example. For a brazed version, to insure a good contact during brazing, the cover shell 14 may be partially split into many segments which is easily done when the cover shell 14 is a sheet metal part that is made in a pressing process. These slots may also serve to be filled with the brazing material during the brazing process. For simplicity, the cover shell 14 may be a part of a revolution, which is easy to make.

The casing shell 12 is preferably made from castings, or from a plasma spray process, To ensure accurate throat and a good knife edge, the casing shell 12 is machined on this region before the cover shell is attached if needed.

The thickness of the shells 12 and 14 can be substantially uniform therethrough, or if desired for vibration control, structural strength or wear resistance, the shells 12 and 14 can easily be designed with preselected zones of increased relative thickness.

The grooves 30 of the casing shell 12 have a cross-sectional area of increasing magnitude from the compressor impeller casing 16 to the outer edge 18. In the embodiment illustrated, the grooves 30 are U-shaped as shown in FIG. 2 most clearly. However, the grooves 30 also could be V-shaped or a combination of the U and V shape.

As well, in the illustrated embodiment, the groove 30 has both a depth and width being of increasing magnitude from the compressor impeller casing 16 to the outer edge 18, as indicated in FIG. 1 and FIG. 3 respectively.

It will be understood that the shape and orientation of the diffuser ducts shown in the illustrated embodiment are by way of example only. A significant advantage of the invention is to allow the designers to choose any cross-section shape or path orientation for the diffuser ducts which will optimize the efficiency of the diffuser assembly. The U or V shaped duct grooves 30 can as easily be made in any other shape desired. Of particular advantage, the transition between the compressor diffuser 16, 20 and the grooves 30 can be made completely Smooth without the disadvantageous transition steps found in the prior art. The shape of the grooves 30 immediately adjacent to the compressor impeller casing 16 can be any optimal shape determined by designers. In contrast to the diffuser assembly formed by two nested shells with the mating of opposed grooves on each shell, the diffuser assembly 10 as illustrated in this embodiment, the mating of opposed grooves on each shell is eliminated and the casing shell 12 can be nested together with the cover shell 14 in any angular position relative to each other while the seam edges 34 are secured properly to the surface 32 of the cover shell 14.

In this embodiment illustrated, the cover shell 14 is an external shell and the casing shell 12 is an internal, Nevertheless, it is an option for designers to select that either one of the cover shell or casing shell could be an external shell. In the case of the external shell being the casing shell, the surface having the grooves is an inner surface thereof, and the cover shell that is the external one has the smooth surface of revolution as an outer surface thereof.

As a result therefore, the novel dual shell diffuser assembly provided by the invention significantly reduces the number of parts and tooling required. Better vibration control and prediction results from the structural integrity of the dual shell structure. Lower engine weight is possible by using curved or variable diffusion diffuser ducts to reduce the gas generator case diameter. Furthermore, the external shell, whether it is the cover shell or casing shell, may be integrated into a casing wall of the gas generator to further reduce the overall weight of the engine if desired. Designers are free to quickly develop new engine types with non-circular diffuser ducts it also desired. Since fewer operations are required in production, there is considerably shorter lead time required in producing diffuser assemblies. Better aerodynamic performance will result from the elimination of internal transversal steps present in the prior art between separate components of the diffuser assembly.

Although the above description and accompanying drawings relate to a specific preferred embodiment as presently contemplated by the inventors, it will be understood that the invention in its broad aspects includes mechanical and functional equivalents of the elements described and illustrated, which are within its spirit and scope as defined by the appended claims.

We claim:

1. A diffuser assembly for directing a flow of compressed air with a radial component from a centrifugal compressor impeller to a diffused annular flow having an axial component, comprising:

a first bowl-shaped casing shell having a first annular diffuser portion, a first downstream annular edge co-axial with the first annular diffuser portion, and a surface having a plurality of grooves extending therebetween and separated by seam edges;

a second bowl-shaped casing shell having a second annular diffuser portion concentric with the first annular diffuser portion, a second annular downstream edge co-axial with the second diffuser portion, and a smooth surface of revolution extending therebetween; and the first and second bowl-shaped casing shells being concentrically nested, the second shell closing the grooves at the surface of revolution thus defining a diffuser at the first and second diffuser portions and a plurality of individual diffuser pipes extending from the diffuser to the first and second downstream edges when the seam edges of the first shell are secured to the surface of revolution of the second shell.

2. The diffuser assembly as claimed in claim 1 wherein the first shell is an inner shell, the surface having the grooves being an external surface thereof, and the second shell is correspondingly an outer shell the surface of revolution being an internal surface thereof.

3. The diffuser assembly as claimed in claim 1 wherein the seam edges are disposed on lands extending laterally between adjacent grooves.

4. The diffuser assembly as claimed in claim 1 wherein the lands extend continuously the length of the grooves.

5. The diffuser assembly as claimed in claim 1 wherein the grooves have a cross-sectional area of increasing magnitude from the diffuser to the first and second downstream edges.

6. The diffuser assembly as claimed in claim 1 wherein the grooves are formed with combination of straight and curved surfaces.

7. The diffuser assembly as claimed in claim 1 wherein the grooves have a U-shaped cross section.

8. The diffuser assembly as claimed in claim 1 wherein the first shell is of substantially uniform thickness throughout.

9. The diffuser assembly as claimed in claim 1 wherein the first shell has pre-selected zones of increased relative thickness.

10. The diffuser assembly as claimed in claim 1 wherein the first shell is made of a metal casting.

11. The diffuser assembly as claimed in claim 1 wherein the first and second shells have machined surfaces.

12. The diffuser assembly as claimed in claim 1 wherein the second shell is formed with a relative thin wall thickness.

13. The diffuser assembly as claimed in claim 12 wherein the second shell is made of sheet metal.

14. The diffuser assembly as claimed in claim 13 wherein the second shell is made from a pressing process.

15. The diffuser assembly as claimed in claim 1 wherein the seam edges of the first shell are secured to the surface of revolution of the second shell with fastening means selected from the group consisting of: brazed surfaces; rivets; bolts; spot welds; and continuously welded surfaces.

16. The diffuser assembly as claimed in claim 2 wherein the second shell is integrated into a casing wall of a gas generator.

17. The diffuser assembly as claimed in claim 3 wherein the first shell is integrated into a casing wall of a gas generator.

* * * * *